US011261627B2

(12) United States Patent
Mitchell et al.

(10) Patent No.: US 11,261,627 B2
(45) Date of Patent: Mar. 1, 2022

(54) MAGNET LATCH

(71) Applicant: Kason Industries, Inc., Newnan, GA (US)

(72) Inventors: Brett A. Mitchell, Newnan, GA (US); Burl M. Finkelstein, Newnan, GA (US); Andrew Bassett, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 709 days.

(21) Appl. No.: 16/059,495

(22) Filed: Aug. 9, 2018

(65) Prior Publication Data

US 2020/0048943 A1 Feb. 13, 2020

(51) Int. Cl.
*E05C 19/16* (2006.01)
*E05C 17/56* (2006.01)

(52) U.S. Cl.
CPC ..... *E05C 17/56* (2013.01); *E05C 19/16* (2013.01); *E05Y 2201/42* (2013.01); *E05Y 2201/46* (2013.01); *E05Y 2800/68* (2013.01); *E05Y 2900/30* (2013.01)

(58) Field of Classification Search
CPC ..... E05C 19/16; E05C 19/165; E05C 19/56; E05C 17/56; Y10T 292/11; Y10T 292/71; F24B 1/192; A21B 3/02; F24C 15/02
See application file for complete search history.

(56) References Cited

U.S. PATENT DOCUMENTS 2,659,115 A * 11/1953 Anderson ..... E05C 19/161 49/277
2,693,382 A * 11/1954 Teetor ..... E05C 19/16 292/251.5
3,201,960 A * 8/1965 Berkowitz ..... E05C 19/16 70/150

(Continued)

FOREIGN PATENT DOCUMENTS

JP 2007027615 A * 2/2007 ..... H01F 7/02

OTHER PUBLICATIONS

Girifalco, et al., "Materials science," Apr. 29, 2016, Encyclopedia Britannica, Britannica Academic, academic.eb.com/levels/collegiate/article/materials-science/109860#32304.toc. Accessed Feb. 25, 2021. (Year: 2016).*

*Primary Examiner* — Kristina R Fulton
*Assistant Examiner* — Emily G. Brown
(74) *Attorney, Agent, or Firm* — Baker, Donelson, Bearman, Caldwell & Berkowitz, PC; Dorian B. Kennedy

(57) ABSTRACT

A magnetic latch (10) for an appliance is disclosed for use with a strike plate (12). The latch includes a body (16) having two oppositely disposed side walls (18) and a bottom surface or wall (20). The body defines a magnet recess (26). An elongated handle (40) is pivotally coupled to the body. A spring loaded plunger pin (34) biases the handle. A magnet assembly (44) is positioned within the body. The magnet assembly includes a magnet (46) having a peripheral edge (48), and a pair of metal plates (54). The magnet has a peripheral cushioning sleeve (58) extending about the (Continued)

peripheral edges of the magnet. The peripheral sleeve is generally rectangular in shape having two oppositely disposed end walls (60) which include a cushioning projection (68). A pivot pin (74) extends through the magnet assembly to allow rocking motion.

15 Claims, 3 Drawing Sheets

(56) References Cited

U.S. PATENT DOCUMENTS

| | | | | |
|---|---|---|---|---|
| 5,190,325 | A * | 3/1993 | Doss-Desouza | E05C 19/16 292/251.5 |
| 7,045,202 | B2 * | 5/2006 | Tanaka | C08J 3/226 264/172.13 |
| 7,377,560 | B2 * | 5/2008 | Wiemer | E05C 19/16 292/251.5 |
| 2009/0250949 | A1 * | 10/2009 | Sharpe | E05C 19/16 292/251.5 |
| 2016/0213898 | A1 * | 7/2016 | Leung | H01F 7/02 |

* cited by examiner

MAGNET LATCH

TECHNICAL FIELD

This invention relates generally to latches and particularly to the magnetic component of a latch.

BACKGROUND OF THE INVENTION

Many appliances today include pivotable doors, such as ovens and the like. These doors have a latch which maintains the door in a closed position, but when operated opens the door to allow access to the oven's interior.

One type of oven door latch consists of a latch which is mounted to the edge of the door oppositely disposed from the door hinges. The latch includes a strong magnet which is magnetically attracted to a metal strike plate mounted to the appliance adjacent the door edge. The magnetic attraction between the magnetic edge mounted door latch and the metal strike plate maintains the door in its closed position. The magnets of these latches may have a flat magnetic pulling force of approximately 100 pounds.

To open the door with such an edge mounted magnetic latch, the latch includes a pivotable handle which actuates a plunger pin that extends from the latch and pushes upon the metal strike plate to move or pivot the latch away from the metal strike plate. This movement of the latch separates the latch from the metal strike plate a distance sufficient to break the strong magnetic attraction or pull between these components, thereby allowing the door to be opened.

Typically, these magnets are made of a ceramic material and are generally in a rectangular shape. One problem associated with these magnets is that the corners of the magnets are susceptible to chipping and cracking upon impact with the metal strike plate. The chipped portions of the magnet may cause problems with a proper closing and sealing of the oven, may fall within the food being prepared within the oven, or may weaken the magnet over time.

Accordingly, it is seen that a need exists for a magnetic latch which does not include a magnet that is easily chipped or cracked during use. It is to the provision of such therefore that exemplary embodiments of the present invention are primarily directed.

DETAILED DESCRIPTION

Figure 1:
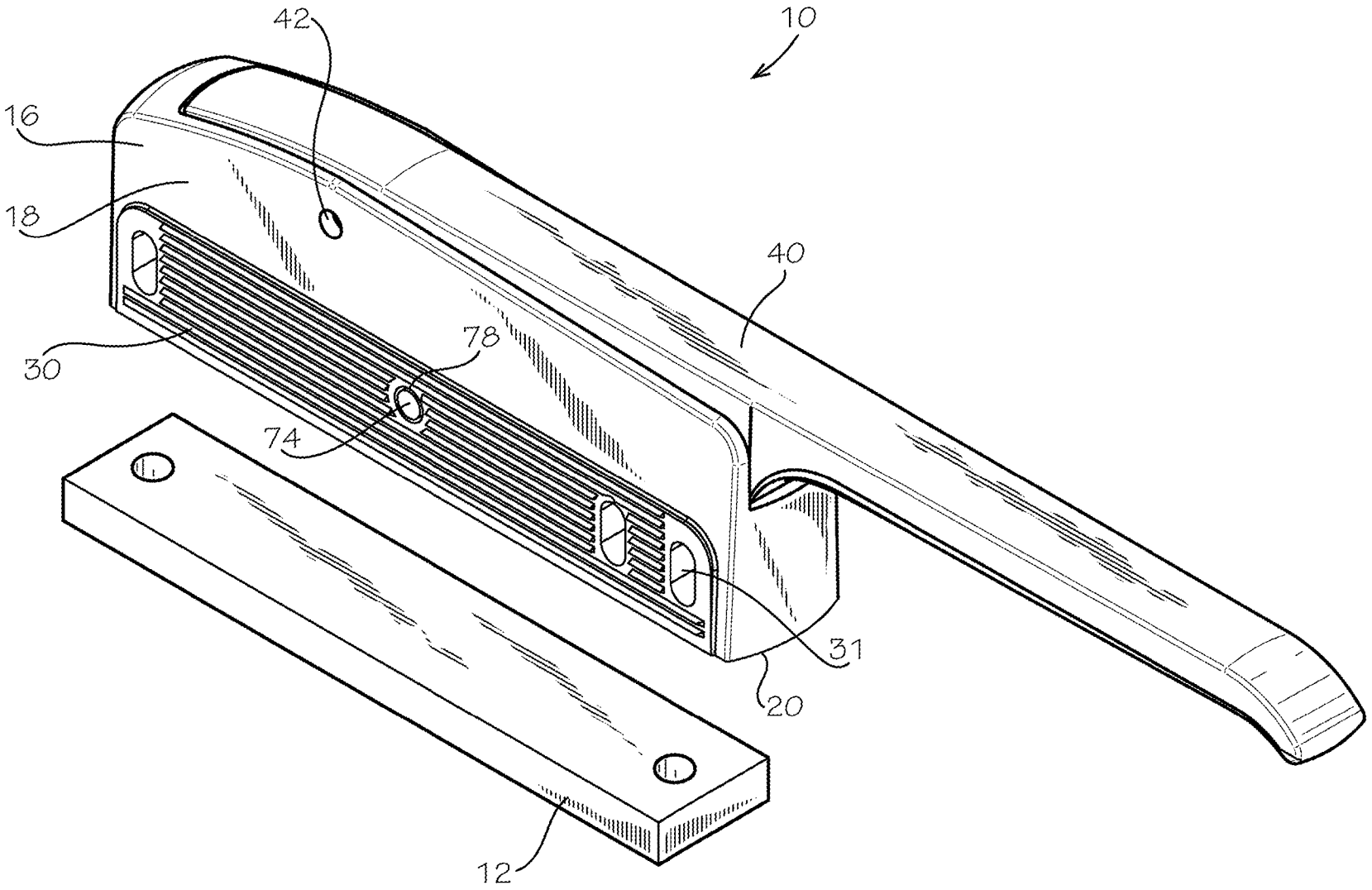
FIG. 1 is a perspective view of a magnetic latch that embodies the invention in a preferred form.
Figure 2:
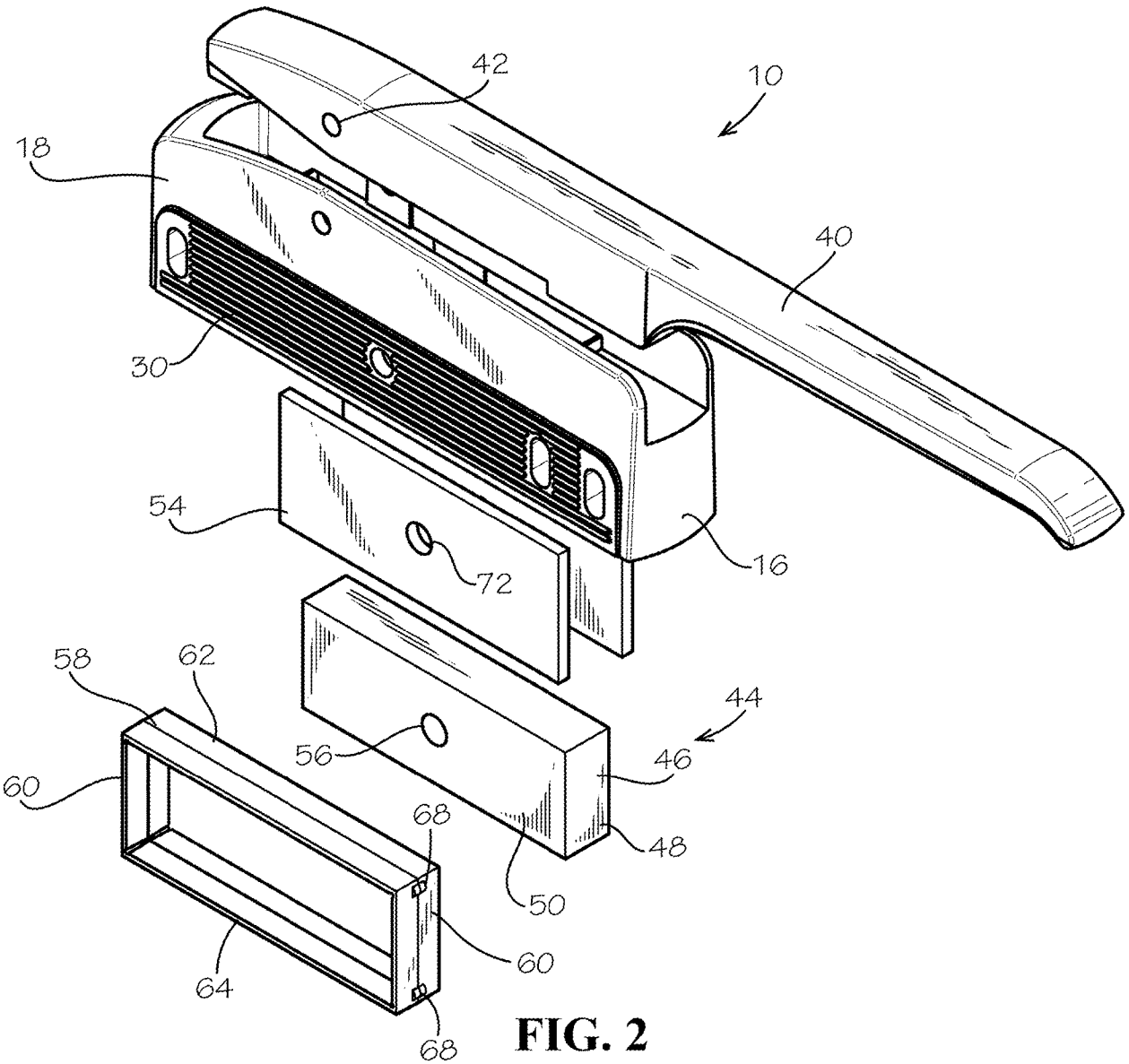
FIG. 2 is an exploded, perspective view of the latch of FIG. 1.
Figure 3:
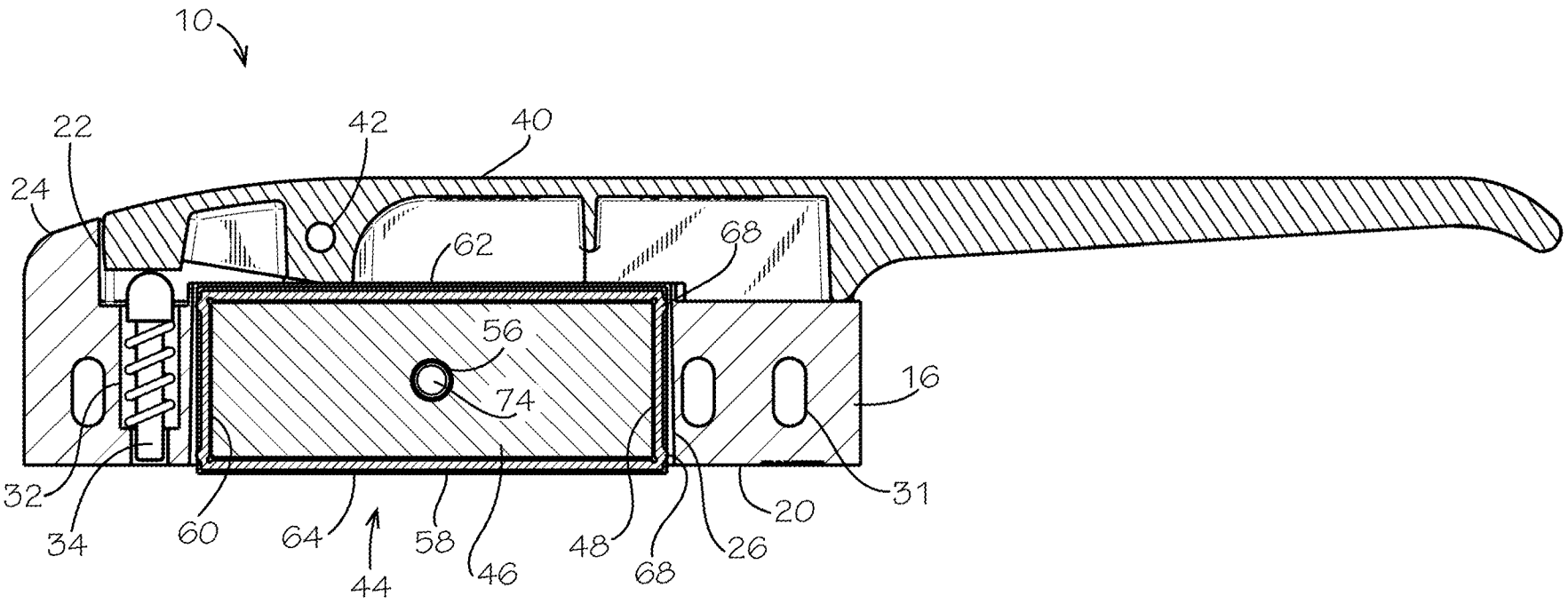
FIG. 3 is a cross-sectional side view of the latch of FIG. 1.

With reference to the drawings, there is shown a latch 10 for an appliance, such as a commercial oven, according to the present invention. The latch 10 is used in conjunction with a strike or strike plate 12 that is attached to a door of an oven to control and/or restrict opening of the door and access the interior of the oven.

The latch 10 includes a base or body 16 having two oppositely disposed side walls 18 and a bottom surface or wall 20. The body 16 defines a handle recess 22 extending from a top surface 24 of the body 16, and a magnet recess 26 extending from the bottom wall 20. The body 16 may include an optional cylinder lock channel which is configured to receive an optional cylinder lock. The side walls 18 have a series of parallel ribs 30 and mounting holes 31 extending therethrough which enable the latch 10 to be mounted to the edge of a door through unshown, conventional mounting bolts and an similarly ribbed unshown adjustable mounting plate.

The body 16 also includes a push or plunger pin channel 32 which extends from the bottom wall 20. A spring loaded push or plunger pin 34 is positioned within the plunger pin channel 32 for reciprocal movement therein between a stowed position residing within the body 16 and an extended position protruding from the bottom wall 20 of the body 16.

An elongated handle 40 is pivotally coupled to the body 16 within the handle recess 22 through a pivot pin 42 mounted to the side walls 18. The spring loaded plunger pin 34 biases the handle 40 from an oven opening, engaged position, pivoted away from the body, towards its stowed position, shown in the drawings. With the handle 40 manually pivoted in its engaged position, the handle 40 forces the plunger pin 34 to its extended position.

A magnet assembly 44 is positioned within the magnet recess 26. The magnet assembly 44 includes a centrally positioned magnet 46 having a peripheral edge 48 extending between oppositely disposed side surfaces 50, and a pair of oppositely disposed generally planar metal plates 54 sandwiching the magnet 46 therebetween. The magnet 46 has a central mounting hole 56 therethrough. The magnet 46 also has a pliable, peripheral cushioning sleeve 58 extending about the peripheral edges 48 of the magnet 46. The peripheral cushioning sleeve 58 is generally rectangular in shape having two oppositely disposed end walls 60 spanned by a top wall 62 and a bottom wall 64. The peripheral sleeve end walls 60 overlay the magnet end edges or surfaces, the peripheral sleeve top wall 62 overlays the magnet top edge or surface, and the peripheral sleeve bottom wall 64 overlays the magnet bottom edge or surface. The end walls 60 include an outwardly extending cushioning projection or rib 68 positioned closely adjacent the top and bottom corners of the peripheral sleeve 58. The peripheral sleeve 58 has a thickness of approximately 1/16 inch. The peripheral sleeve 58 is made of a glass filled nylon or other heat resistive polymer.

Similarly, the metal plates 54 each have a central mounting hole 72 therethrough which are aligned with magnet mounting hole 56. The metal plates 54 are sized and shaped to overlay the magnet and the peripheral sleeve 58.

A pivot pin 74 extends through the metal plate mounting holes 72 and magnet mounting hole 56 and is mounted within side wall mounting holes 78 extending through the side walls 18 of the body 16. The magnet 46 and metal plates 54 are of generally the same rectangular size and shape. The size and shape of the magnet assembly 44 is slightly smaller than the size and shape of the magnet recess 26 so that the magnet assembly 44 may rock slightly about pivot pin 74 and within the confines of the magnet recess 26.

In use, the latch 10 is mounted to the side edge of a door, such as an oven door, by placing the latch 10 against the door and positioning an unshown ribbed adjustable mounting plate against the outer facing side wall 18, so that the ribs of the adjustable mounting plate mesh with the ribs 30 of the latch 10 at a proper distance from the strike plate 12 mounted to the main portion of the oven. Mounting screws are then passed through holes within the adjustable mounting plate and through the mounting holes 31 of the latch and are then threaded into mounting holes in the door. With the latch 10 properly mounted, the magnetic force between the magnet assembly 44 and the strike plate 12 maintains the door in a door closed position.

To open the door, a person pulls upon the elongated handle 40 thereby causing the handle 40 to pivot about pivot pin 42. The pivotal movement of the handle 40 causes the handle 40 to be forced against the plunger pin 34 thereby causing the plunger pin 34 to be moved to its extended position protruding from the bottom wall 20 and bearing against the strike plate 12. The pushing force of the plunger pin 34 against the strike plate 12 causes the latch 10 and connected door to move away from the strike plate 12, thereby weakening the magnetic force and allowing the separation of the magnetic assembly 44 from the strike plate 12 to allow the opening of the door.

The limited rocking of the magnet assembly 44 about pivot pin 74 and within the magnet recess 26 allows the magnet assembly 44 to be aligned parallel with the strike plate 12 for optimal magnetic attraction. The rocking of the magnetic assembly compensates for any discrepancy regarding the parallel orientation between the latch and the strike plate. Generally, the bottom wall 64 of the peripheral sleeve 58 is parallel or flush against the strike plate 12, i.e., the bottom wall 64 lies on a plane which is parallel with the plane in which the strike plate surface facing the magnet lies.

The peripheral sleeve 58 encases the peripheral edge 48 of the magnet 46. The soft material from which the peripheral sleeve 58 is made protects the magnet from damage causes by contact with the strike or other object. Furthermore, if the magnet does become damaged due to contact, any resulting fragments of the magnet material are contained by the peripheral sleeve 58, thus preventing the fragments from interfering with the operation of the oven or accidental inclusion into the food cooked within the oven.

It should be noted that the rocking motion or ability of the magnet assembly 44 about the pivot pin 74 may also cause a greater amount of impact or stress upon the corners of the magnet 46. For this reason, the peripheral sleeve 58 is provided with the cushioning projections or ribs 68 on the end walls 60 closely adjacent each corner. The cushioning ribs 68 provide an extra amount of peripheral sleeve material in these areas to absorb more impact, i.e., provide a greater degree of impact resistance upon the corners of the magnet 46.

The peripheral sleeve 58 is made of a material which preferably consists of a mixture of a polymer, such as nylon, with glass particles such as beads, fibers or threads therein. The inclusion of glass particles allows the peripheral sleeve 58 to have a higher resistance to heat. This is advantageous when placing the latch on an appliance which produces a large amount of heat, such as on the door of an oven.

It should be understood that the foregoing descriptions merely relate to exemplary, illustrative embodiments of the invention. Therefore, it should also be understood that various modifications may be made to exemplary embodiments described herein that are within the scope of the invention, which will be recognized by one of ordinary skill in the art in light of the disclosure herein. Furthermore, various elements of the described exemplary embodiments of the invention may be known in the art or recognized by one of ordinary skill in the art based on the disclosure herein.

The invention claimed is:

1. An appliance latch comprising:

a latch body having a magnet recess extending from a bottom surface;

a handle coupled to said latch body, and a magnet assembly positioned within said magnet recess of said latch body, said magnet assembly including a magnet having two oppositely disposed side surfaces and a peripheral edge extending about said side surfaces, and a pliable, peripheral cushioning sleeve mounted about the entire peripheral edge of said magnet but not extending over said side surfaces of said magnet, wherein said cushioning sleeve includes an outwardly extending cushioning projection adjacent a corner of said magnet.

2. The appliance latch of claim 1 wherein said latch body includes a plunger pin channel and a plunger pin coupled to said handle for reciprocal movement of said plunger pin between a stowed position within said latch body and an extended position extending from said latch body.

3. The appliance latch of claim 1 wherein said cushioning sleeve is made of a material consisting of a polymer and glass particles.

4. An appliance latch comprising:

a latch body having a magnet recess extending from a bottom surface;

a handle coupled to said latch body, and a magnet assembly positioned within said magnet recess of said latch body, said magnet assembly including a magnet having two oppositely disposed side surfaces and a peripheral edge extending about said side surfaces, and a pliable, peripheral cushioning sleeve mounted about at least a portion of said peripheral edge of said magnet but not extending over said side surfaces of said magnet, wherein said magnet includes a bottom edge, a top edge, and two oppositely disposed side edges, and wherein said cushioning sleeve includes a bottom wall overlaying said magnet bottom edge, a top wall overlaying said magnet top edge, and two oppositely disposed side walls overlaying said magnet side edges.

5. The appliance latch of claim 4 wherein each said cushioning sleeve side wall includes at least one cushioning projection extending therefrom.

6. The appliance latch of claim 5 wherein said at least one cushioning projection is positioned closely adjacent said cushioning sleeve bottom wall.

7. The appliance latch of claim 4 wherein each said cushioning sleeve side wall includes a first projection positioned adjacent said top wall and a second projection positioned adjacent said bottom wall.

8. An appliance latch comprising: a latch body having a magnet recess extending from a bottom surface; a handle coupled to said latch body, and a magnet assembly positioned within said magnet recess of said latch body, said magnet assembly including a magnet having two oppositely disposed side surfaces and a peripheral edge extending about said side surfaces, a pliable, peripheral cushioning sleeve mounted about at least a portion of said peripheral edge of said magnet but not extending over said side surfaces of said magnet, and two planar metal plates, each metal plate being positioned upon one side of said magnet, wherein each said metal plate overlays said cushioning sleeve.

9. An appliance latch comprising:

a latch body;

a handle coupled to said latch body; and a magnet assembly coupled to said latch body, said magnet assembly including a magnet having two oppositely disposed side surfaces and a peripheral edge extending between said two side surfaces, a pair of metal plates wherein each metal plate overlays one said side surface of said magnet, and a cushioning sleeve mounted over said peripheral edge of said magnet, said cushioning sleeve being configured to allow direct contact between said side surfaces of said magnet with said metal plates, wherein said cushioning sleeve includes an outwardly extending cushioning projection adjacent a corner of said magnet.

10. The appliance latch of claim 9 wherein said cushioning sleeve extends about the entire peripheral edge of said magnet.

11. The appliance latch of claim 9 wherein said magnet is rectangular and wherein said cushioning sleeve is rectangular so as to define four corners, and wherein said cushioning sleeve includes a cushioning projection adjacent each corner of said cushioning sleeve.

12. The appliance latch of claim 9 wherein said latch body includes a plunger pin channel and a plunger pin coupled to said handle for reciprocal movement of said plunger pin between a stowed position within said latch body and an extended position extending from said latch body.

13. The appliance latch of claim 9 wherein said cushioning sleeve is made of a material consisting of a polymer and glass particles.

14. The appliance latch of claim 13 wherein said glass particles are selected from the group consisting of glass beads, glass threads, and glass fibers.

15. An appliance latch comprising:

a latch body;

a handle coupled to said latch body; and a magnet assembly coupled to said latch body, said magnet assembly including a magnet having two oppositely disposed side surfaces and a peripheral edge extending between said two oppositely disposed side surfaces, a pair of metal plates wherein each metal plate overlays one said side surface of said magnet, and a cushioning sleeve mounted over said peripheral edge of said magnet, said cushioning sleeve being configured to allow direct contact between said side surfaces of said magnet with said metal plates, wherein each said metal plate overlays said cushioning sleeve.

* * * * *